US006814154B2

(12) United States Patent
Chou

(10) Patent No.: US 6,814,154 B2
(45) Date of Patent: Nov. 9, 2004

(54) POWER TOOL HAVING AUTOMATICALLY SELECTIVE DRIVING DIRECTION

(76) Inventor: Wen San Chou, No. 1-25, Kang Wei Village, An Din Ksiang, Tainan Hsien (TW)

( * ) Notice: Subject to any disclaimer, the term of this patent is extended or adjusted under 35 U.S.C. 154(b) by 0 days.

(21) Appl. No.: 10/252,167

(22) Filed: Sep. 23, 2002

(65) Prior Publication Data

US 2004/0055769 A1 Mar. 25, 2004

(51) Int. Cl.[7] ..... B25D 15/00

(52) U.S. Cl. ..... 173/93; 173/47; 173/216; 173/217

(58) Field of Search ..... 173/217, 216, 173/93, 93.5, 47

(56) References Cited

U.S. PATENT DOCUMENTS 2,028,441 A * 1/1936 Decker ..... 173/13
4,106,572 A * 8/1978 Anderson ..... 173/93
4,947,939 A * 8/1990 Hung ..... 173/179
5,435,398 A * 7/1995 Juan ..... 173/176
5,740,892 A * 4/1998 Huang ..... 192/43.1
5,887,666 A 3/1999 Chen et al. ..... 173/93.5
5,941,319 A * 8/1999 Juan ..... 173/93.5
6,119,794 A * 9/2000 Chen ..... 173/93
6,186,247 B1 * 2/2001 Wang ..... 173/93.5
6,283,226 B1 9/2001 Chen ..... 173/93.5
6,491,112 B1 * 12/2002 Shin ..... 173/93.5

* cited by examiner

*Primary Examiner*—Eugene Kim
*Assistant Examiner*—Paul Durand
(74) *Attorney, Agent, or Firm*—Charles E. Baxley

(57) ABSTRACT

A power tool includes a housing rotatably secured to a seat and having an internal gear and having a bore for rotatably receiving a driving shaft. A motor is secured to the seat and includes a spindle having a pinion engaged with the internal gear for driving the housing to rotate relative to the seat. A pawl is rotatably secured in the housing, and has two ends selectively engaged with the shaft to rotate the shaft in either direction when the housing is rotated relative to the seat by the motor with a speed greater enough to cause the pawl to engage with the shaft.

6 Claims, 5 Drawing Sheets

POWER TOOL HAVING AUTOMATICALLY SELECTIVE DRIVING DIRECTION

BACKGROUND OF THE INVENTION

1. Field of the Invention

The present invention relates to a power tool, and more particularly to a power tool having a mechanism for automatically driving tool members in either of the driving directions.

2. Description of the Prior Art

Various kinds of typical power tools have been developed for driving tool members with motors or the other hydraulic or pneumatic driving mechanisms. Two examples of the typical power tools have been disclosed in U.S. Pat. No. 5,887,666 to Chen et al., and U.S. Pat. No. 6,283,226 to Chen.

The typical power tools comprise a shaft selectively operated by a motor in either of two driving directions. However, a number of parts or elements are required to be assembled together with shafts or rods and fasteners and will be disengaged from each other after high speed rotational operations.

In addition, the driving shaft and a number of parts, particularly some of the springs will be rotated in fast speed by the motor, such that the spring biasing forces of the springs will be decreased after use. However, the springs of the typical power tools may not be adjusted to different resiliences.

The present invention has arisen to mitigate and/or obviate the afore-described disadvantages of the conventional power tools.

SUMMARY OF THE INVENTION

The primary objective of the present invention is to provide a power tool including a mechanism for automatically driving tool members in either of the driving directions.

The other objective of the present invention is to provide a power tool including an integral housing for stably receiving the pawl and the spring and the other parts or elements.

The further objective of the present invention is to provide a power tool including a spring that may be adjusted to different spring biasing forces against the pawl.

The still further objective of the present invention is to provide a power tool including a housing having an internal gear for engaging with the pinion of the motor and for allowing the housing to be solidly driving by the motor.

In accordance with one aspect of the invention, there is provided a power tool comprising a seat, a housing rotatably secured to the seat, and including an internal gear formed and provided therein, the housing including a bore formed therein, and including a notch formed therein and communicating with the bore thereof, a motor attached to the seat, and including a spindle having a pinion secured thereto and engaged with the internal gear of the housing, for driving the housing to rotate relative to the seat, a shaft rotatably received in the bore of the housing, and including two cavities formed therein and spaced from each other, a pawl rotatably secured in the notch of the housing, and including two ends caused to selectively engage with the cavities of the shaft when the housing is rotated relative to the seat by the motor greater than a predetermined speed, and means for biasing the ends of the pawl from the cavities of the shaft when the housing is rotated relative to the seat by the motor in a speed less than the predetermined speed.

The housing includes two walls having the notch formed between the walls, the walls each includes a hole formed therein, and a pin engaged through the pawl and having two ends engaged in the holes of the walls.

The cavities of the shaft are offset from each other, a first of the cavities of the shaft is located closer to the seat.

The seat includes an aperture formed therein, a collar engaged in the aperture of the seat, the shaft includes a rod rotatably engaged in the collar.

The biasing means includes a spring member secured to the housing for engaging with the pawl and for disengaging the ends of the pawl from the cavities of the shaft.

The housing includes a plurality of juts provided thereon, the spring member includes a first end selectively secured to either of the juts.

An actuator may further be provided and slidably engaged in the housing for engaging with the pawl to disengage the ends of the pawl from the cavities of the shaft.

The actuator includes a pair of ears and a slot formed between the ears for receiving the spring member and for preventing the spring member from moving laterally relative to the actuator.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
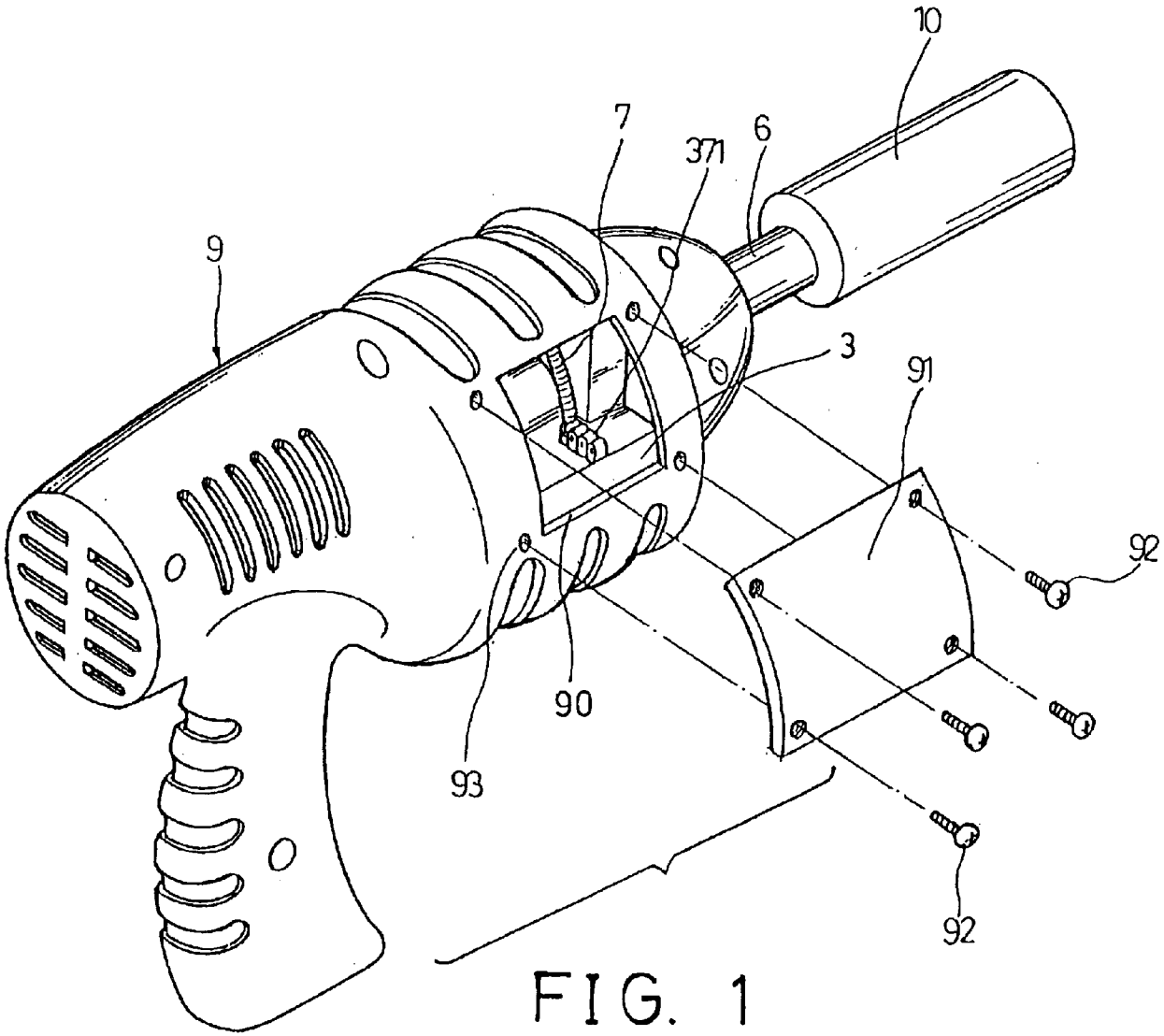
FIG. 1 is a partial exploded view of a power tool in accordance with the present invention.

Referring to the drawings, and initially to FIG. 1, a power tool in accordance with the present invention comprises a tool body 9 including such as a gun-shape having a window 90 formed or provided on one side portion thereof for assembling or repairing the parts or elements or the like.

A cover 91 may be provided for enclosing the window 90, and may be secured to the tool body 9 with fasteners 92 that may be threaded with the screw holes 93 of the tool body 9. The tool body 9 further includes an open front for receiving or assembling the parts or elements into the tool body 9.

Figure 2:
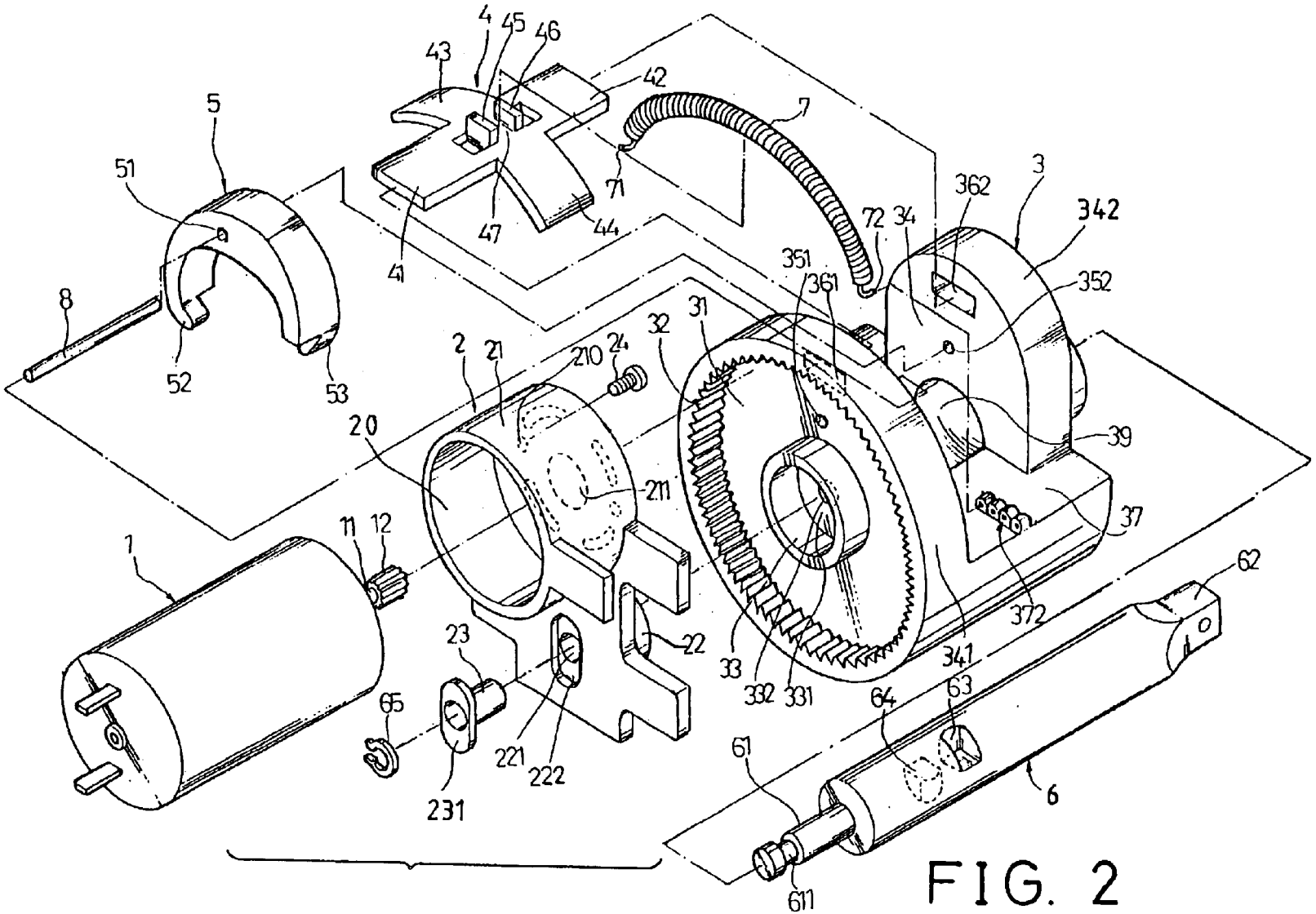
FIG. 2 is a partial exploded view illustrating the driving mechanism of the power tool.
Figure 3:
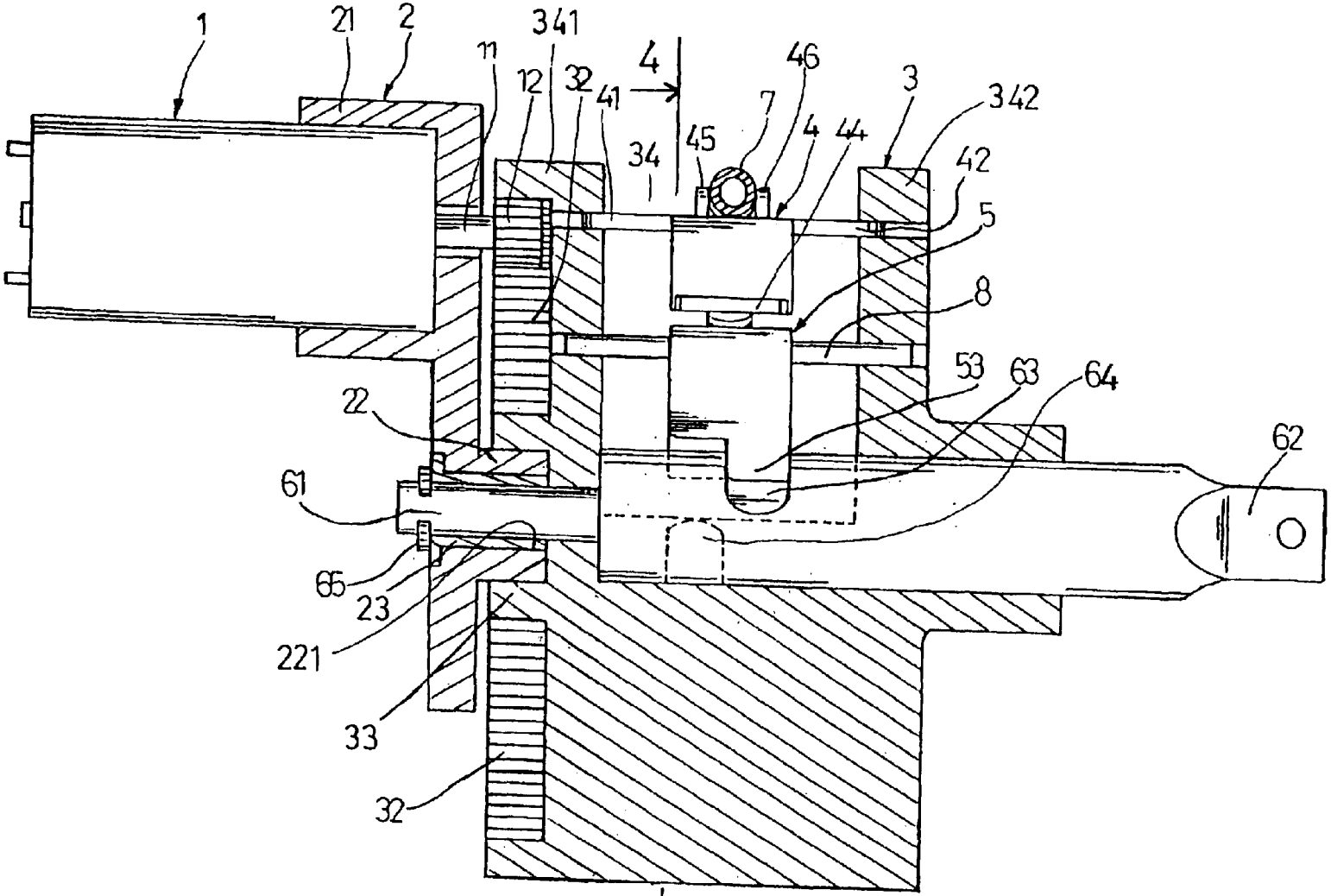
FIG. 3 is a partial cross sectional view taken along lines 3—3 of FIG. 4.
Figure 4:
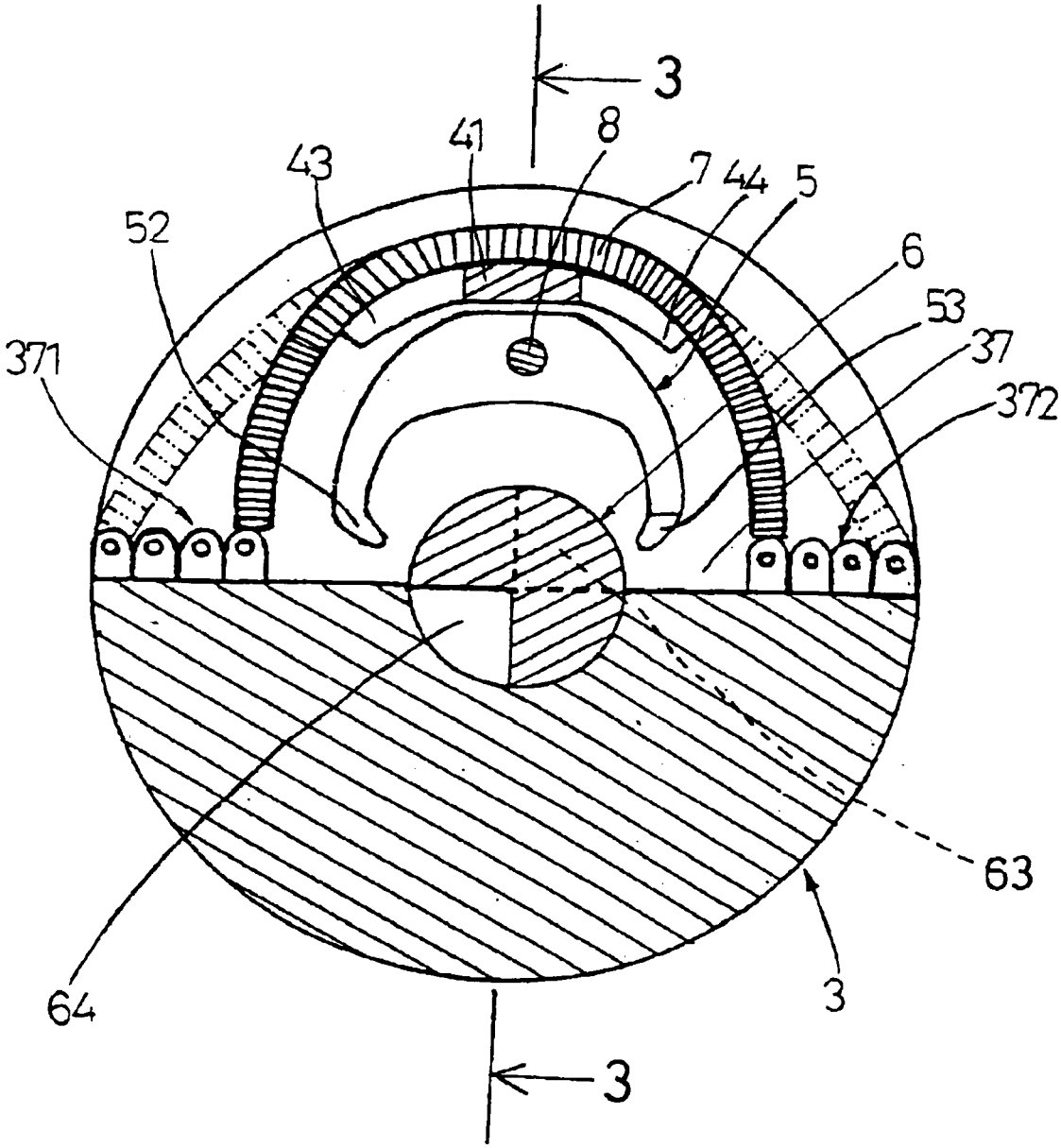
FIG. 4 is a partial cross sectional view taken along lines 4—4 of FIG. 3.

Referring next to FIGS. 2–4, a seat 2 is secured in the tool body 9 with fasteners or latches (not shown) or the like, and includes a hollow interior 20 formed in a casing 21 for partially receiving a motor 1. One or more fasteners 24 may engage through the corresponding holes 210 of the casing 21 for securing the motor 1 to the casing 21.

The motor 1 includes a spindle 11 having a pinion 12 secured thereon, and engaged or extended outwardly through an orifice 211 of the casing 21. The casing 21 further includes an aperture 221 formed therein, and offset from the chamber 20 thereof, and formed or defined in or by a duct 22.

The casing 21 includes a depression 222 formed therein and communicating with the aperture 221 thereof. A collar 23 is received in the aperture 221 of the casing 21, and includes a flap 231 extended radially outwardly from one end thereof and secured in the depression 222 of the casing 21 by such as a force-fitted engagement, for preventing the collar 23 from rotating relative to the casing 21.

A housing 3 includes a chamber 31 and an internal gear 32 formed or provided in one end thereof, and a hub 33 extended from an end wall 331 and extended into the chamber 31 thereof for rotatably engaging onto the duct 22 of the casing 21. The pinion 12 is engaged with the internal gear 32 (FIG. 3) for rotating or driving the housing 3 relative to the casing 21 and thus the tool body 9.

The housing 3 includes a bore 39 formed therein for rotatably receiving a driving shaft 6, and a hole 332 formed in the center of the hub 33 and the end wall 331 and aligned with the bore 39 thereof for rotatably receiving an extension rod 61 of the shaft 6. The rod 61 has a reduced diameter than that of the shaft 6.

A retaining ring 65 may be engaged onto an annular groove 611 of the rod 61 for rotatably securing the shaft 6 to the seat 2, and also for rotatably securing the housing 3 to the seat 2. The driving shaft 6 includes a driving end 62 for engaging with or for driving various tool members 10, such as the socket 10 as shown in FIG. 1.

The housing 3 includes a notch 34 formed in the middle portion thereof and defined by two walls 341, 342 and a flat base surface 37, and two holes 351, 352 and two channels 361, 362 formed in the walls 341, 342 respectively and aligned with each other, and communicating with the notch 34 of the housing 3, best shown in FIG. 3.

Figure 5:
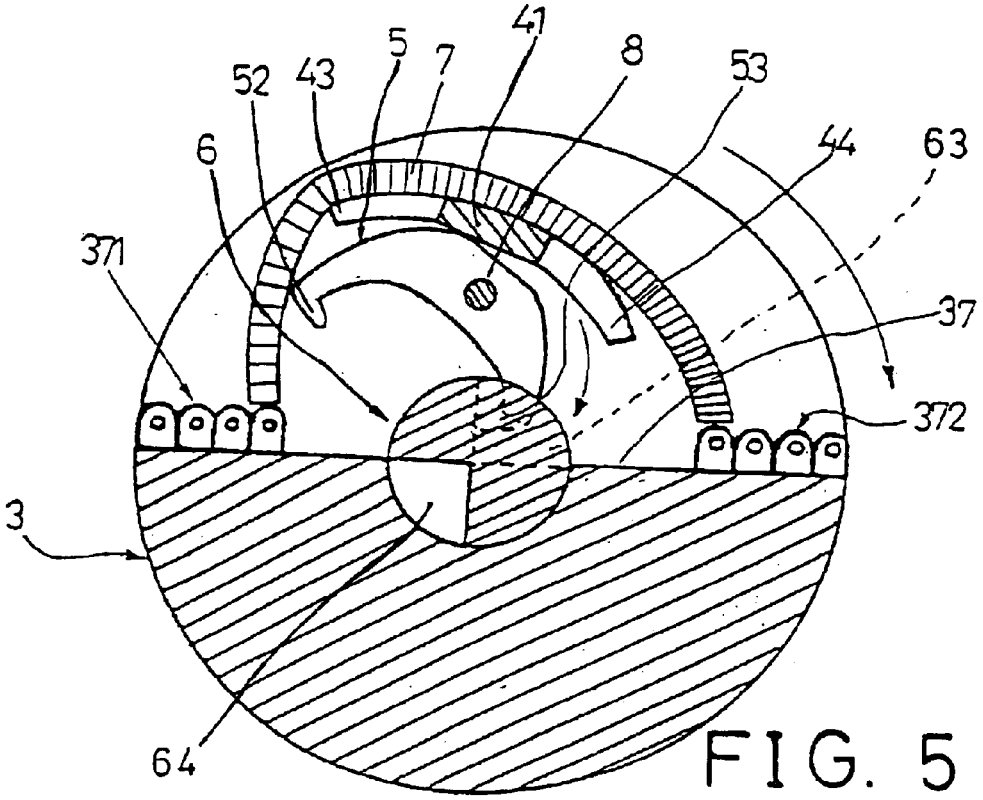
FIGS. 5, 6 are partial cross sectional views similar to FIG. 4, illustrating the operation of the power tool.
Figure 6:
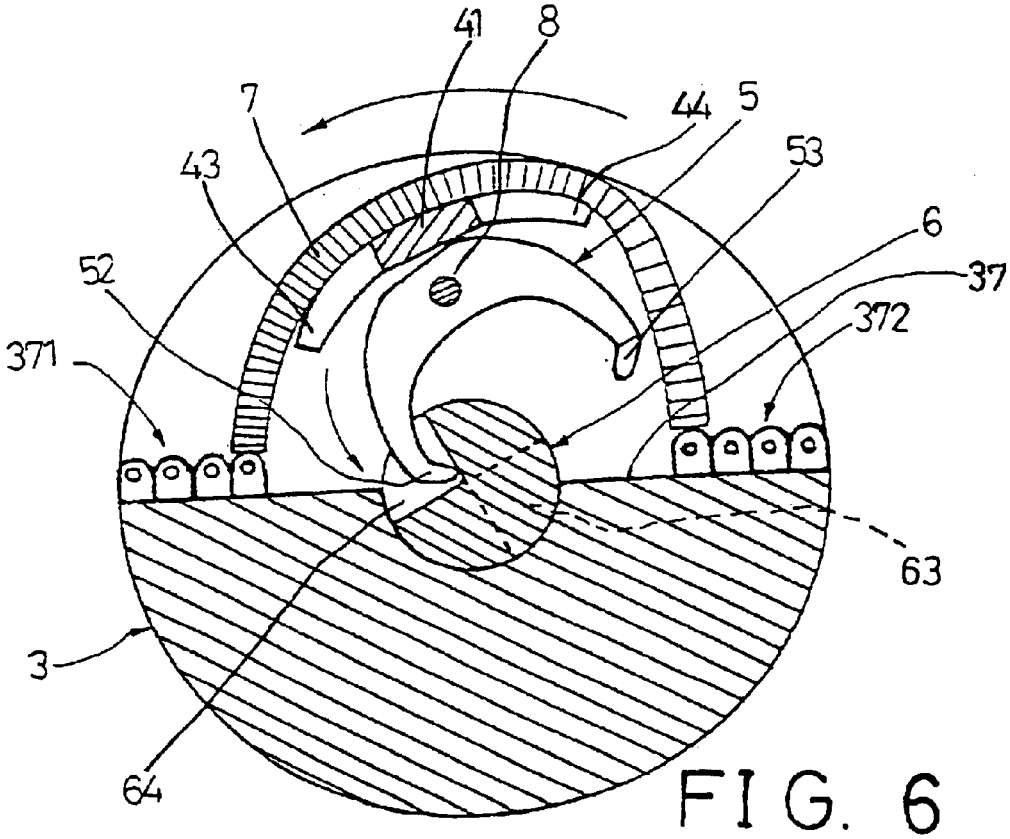

The shaft 6 includes two cavities 63, 64 formed in the middle portion and preferably offset from each other. For example, as shown in FIG. 3, the cavity 63 of the shaft 6 is located in front of the other cavity 64, or closer to the wall 342. The other cavity 64 of the shaft 6 is located closer to the seat 2 and the motor 1. As shown in FIGS. 4–6, the cavities 63, 64 are diametrically opposite to each other.

A pawl 5 has a hole 51 formed in the middle portion thereof for receiving a pin 8 which has two ends engaged in the holes 351, 352 of the housing 3, and which may thus rotatably or pivotally secure the pawl 5 in the notch 34 of the housing 3. The pawl 5 may also be rotated relative to the seat 2 and the tool body 9 or the shaft 6 together with the housing 3.

The pawl 5 has two ends 52, 53 offset from each other, for example, the end 53 is located in front of the other end 52 as shown in FIG. 3, for selectively engaging with the respective cavities 64, 63 of the shaft 6 (FIGS. 5, 6), and thus for allowing the housing 3 to selectively drive the shaft 6 to rotate in either the clockwise direction or the counterclockwise direction (FIGS. 5, 6) respectively.

An actuator 4 has two end projections 41, 42 slidably engaged in the channels 361, 362 of the walls 341, 342 respectively, and has two side flaps 43, 44 laterally extended therefrom. The actuator 4 may be engaged with the pawl 5, for selectively disengaging the ends 52, 53 of the pawl 5 from the respective cavities 64, 63 of the shaft 6 (FIGS. 4–6).

The actuator 4 preferably includes two ears 45, 46 extended therefrom for forming or defining a slot 47 therebetween, and for receiving a spring member 7. The spring member 7 may bias the actuator 4 against the pawl 5, to disengage the ends 52, 53 of the pawl 5 from the respective cavities 64, 63 of the shaft 6.

The housing 3 includes one or more juts 371 and one or more further juts 372 formed or provided on the sides of the flat base surface 37 thereof, for securing or coupling to the ends 71, 72 of the spring member 7 respectively, and adjusting the spring member 7 to apply different spring biasing force against the actuator 4 and the pawl 5.

In operation, as shown in FIG. 4, when the housing 3 has not been rotated or driven by the motor 1, the spring member 7 may center the actuator 4 and thus the pawl 5, to disengage the ends 52, 53 of the pawl 5 from the respective cavities 64, 63 of the shaft 6.

As shown in FIG. 5, when the housing 3 is rotated or driven clockwise by the motor 1 in or greater than a predetermined fast speed, due to moment of inertia, the end 53 of the pawl 5 may be forced or caused to be engaged into the cavity 63 of the shaft 6, such that the shaft 6 may also be rotated or driven clockwise by the motor 1.

At this moment, or when the housing 3 is rotated or driven clockwise by the motor 1 in the predetermined fast speed, the centrifugal force of the pawl 5 relative to the housing 3 is good enough to overcome the spring biasing force of the spring member 7, and to engage one end 53 of the pawl 5 into one cavity 63 of the shaft 6, and to disengage the other end 52 of the pawl 5 from the other cavity 64 of the shaft 6.

On the contrary, as shown in FIG. 6, when the housing 3 is rotated or driven counterclockwise by the motor 1 in a predetermined fast speed good enough to engage the other end 52 of the pawl 5 into the other cavity 64 of the shaft 6, due to moment of inertia, the shaft 6 may thus be rotated or driven counterclockwise by the motor 1.

When the housing 3 is rotated or driven by the motor 1 in a slower speed that is not good enough to engage either of the ends 52, 53 of the pawl 5 into the respective cavities 63, 64 of the shaft 6, the spring member 7 may center the actuator 4 and thus the pawl 5, and thus to disengage the ends 52, 53 of the pawl 5 from the respective cavities 64, 63 of the shaft 6 FIG. 4). At this moment, the shaft 6 may not be rotated or driven by the motor 1 via the housing 3.

It is to be noted that the pawl 5 and the actuator 4 may be solidly and rotatably supported on the housing 3, and retained between the walls 341, 342 of the housing 3. The pinion 12 may be solidly engaged with the internal gear 32 of the housing 3, for stably and solidly driving or rotating the housing 3 relative to the seat 2.

In addition, the ends 71, 72 of the spring member 7 may be selectively coupled to either of the juts 371, 372, for adjusting the spring member 7 to apply different spring biasing force against the actuator 4 and the pawl 5. The spring member 7 may also be directly engaged with the pawl 5 without the actuator 4.

For example, when the resilience or the spring biasing force of the spring member 7 has been reduced, the spring member 7 may be stretched or pulled to engage the ends 71, 72 with the juts 371, 372 that are further spaced from each other, in order to increase the resilience or the spring biasing force of the spring member 7.

Referring again to FIG. 1, the housing 3 may be rotated relative to the tool body 9, such that either of the ends 71, 72 of the spring member 7 or either of the juts 371, 372 may be selectively reached from the window 90 of the tool body 9, and such that the ends 71, 72 of the spring member 7 may be adjusted to be engaged or coupled or secured to either of the juts 371, 372.

Accordingly, the power tool in accordance with the present invention includes a mechanism for automatically driving tool members in either of the driving directions, and includes an integral housing for stably receiving the pawl and the spring and the other parts or elements, and includes a spring that may be adjusted to different spring biasing forces against the pawl.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A power tool comprising:

a seat, a housing rotatably secured to said seat, and including an internal gear formed and provided therein, said housing including a bore formed therein, and including a notch formed therein and communicating with said bore thereof, and including a plurality of first juts provided thereon, a motor attached to said seat, and including a spindle having a pinion secured thereto and engaged with said internal gear of said housing, for driving said housing to rotate relative to said seat, a shaft rotatably received in said bore of said housing, and including two cavities formed therein and spaced from each other, a pawl rotatably secured in said notch of said housing, and including two ends caused to selectively engage with said cavities of said shaft when said housing is rotated relative to said seat by said motor and rotated greater than a predetermined speed, and means for biasing said ends of said pawl from said cavities of said shaft when said housing is rotated relative to said seat by said motor in a speed less than the predetermined speed, said biasing means including a spring member secured to said housing for engaging with said pawl and for disengaging said ends of said pawl from said cavities of said shaft, said spring member including a first end selectively secured to either of said first juts.

2. The power tool according to claim 1, wherein said housing includes two walls having said notch formed between said walls, said walls each includes a hole formed therein, and a pin engaged through said pawl and having two ends engaged in said holes of said walls.

3. The power tool according to claim 1, wherein said cavities of said shaft are offset from each other, a first of said cavities of said shaft is located closer to said seat.

4. The power tool according to claim 1, wherein said seat includes an aperture formed therein, a collar engaged in said aperture of said seat, said shaft includes a rod rotatably engaged in said collar.

5. The power tool according to claim 1, wherein said housing includes a plurality of second juts provided thereon, said spring member includes a second end selectively secured to either of said second juts.

6. A power tool comprising:

a seat, a housing rotatably secured to said seat, and including an internal gear formed and provided therein, said housing including a bore formed therein, and including a notch formed therein and communicating with said bore thereof, and including a plurality of juts provided thereon, a motor attached to said seat, and including a spindle having a pinion secured thereto and engaged with said internal gear of said housing, for driving said housing to rotate relative to said seat, a shaft rotatably received in said bore of said housing, and including two cavities formed therein and spaced from each other, a pawl rotatably secured in said notch of said housing, and including two ends caused to selectively engage with said cavities of said shaft when said housing is rotated relative to said seat by said motor greater than a predetermined speed, means for biasing said ends of said pawl from said cavities of said shaft when said housing is rotated relative to said seat by said motor in a speed less than the predetermined speed, said biasing means including a spring member secured to said housing for engaging with said pawl and for disengaging said ends of said pawl from said cavities of said shaft, and an actuator slidably engaged in said housing for engaging with said pawl to disengage said ends of said pawl from said cavities of said shaft, said actuator including a pair of ears and a slot formed between said ears for receiving said spring member.

* * * * *